United States Patent [19]

Wiles et al.

[11] 4,219,979

[45] Sep. 2, 1980

[54] DECORATIVE JAMB STRUCTURE FOR ELEVATOR ENTRANCEWAYS

[75] Inventors: Bradford Wiles, Glencoe, Ill.; Reuel A. Seaholm, Arkansas City, Kans.

[73] Assignee: Montgomery Elevator Company, Moline, Ill.

[21] Appl. No.: 969,994

[22] Filed: Dec. 15, 1978

[51] Int. Cl.[2] ..... E06B 1/04

[52] U.S. Cl. ..... 52/204; 52/211

[58] Field of Search ..... 52/204, 211, 213, 215, 52/30, 241, 242

[56] References Cited

U.S. PATENT DOCUMENTS

| | | | |
|---|---|---|---|
| 3,908,328 | 9/1975 | Nelsson | 52/242 X |
| 4,064,667 | 12/1977 | Seaholm | 52/215 X |

*Primary Examiner*—Price C. Faw, Jr.
*Assistant Examiner*—Carl D. Friedman
*Attorney, Agent, or Firm*—Wegner, Stellman, McCord, Wiles & Wood

[57] ABSTRACT

A decorative jamb structure for a side of an entranceway through a wall from a corridor to an elevator hatchway that has a sliding door in the hatchway. The jamb structure includes a shroud covering the end of the wall, the shroud having vertical side elements and a recessed connecting web that define a vertical central channel, a retaining flange which cooperates with the connecting web means of the shroud to define a downwardly open pocket at the upper end of the central channel, a finishing plate detachably secured in the lower end portion of the central channel which has a core and a decorative sheath projecting above the core to define an upwardly open pocket, and a decorative panel in the channel which has its end portions snugly seated in the pockets.

5 Claims, 5 Drawing Figures

DECORATIVE JAMB STRUCTURE FOR ELEVATOR ENTRANCEWAYS

BACKGROUND OF THE INVENTION

U.S. Pat. No. 4,064,667, issued Dec. 27, 1977, discloses a novel decorative jamb structure for elevator entranceways.

The structure of the present invention provides alternative means for mounting a decorative panel in an arrangement similar to that of the patent. It eliminates the need for keyhole slots and screws with matching heads; and provides protection for the upper and lower ends of the decorative panel where chipping of the decorative outer surface can occur.

SUMMARY OF THE INVENTION

In accordance with the present invention, a sheet metal shroud structure like that of U.S. Pat. No. 4,064,667 is provided with a top retaining flange which cooperates with the connecting web means of the shroud to define a downwardly open pocket at the upper end of the central channel of the shroud structure. A filler piece detachably secured in the lower end portion of the central channel is similar to that of the patent, but has a decorative sheath projecting above the filler piece core to define an upwardly open pocket; and a decorative panel is mounted in the channel with its end portions snugly seated in the pockets defined by the top retaining flange and the upwardly projecting decorative sheath.

THE DRAWINGS

DETAILED DESCRIPTION OF THE INVENTION

Figure 1:
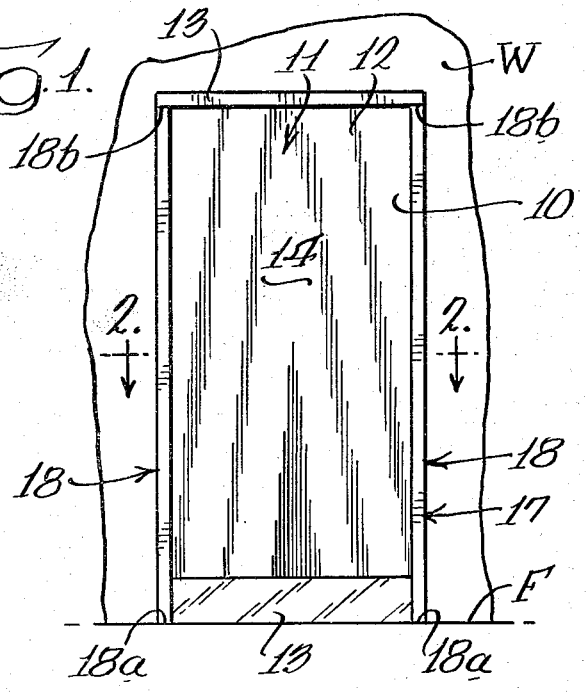
FIG. 1 is a front elevational view of the structure of the present invention, illustrated with a typical sliding hatch door in its closed position.

Referring to the drawings in detail, a wall W is constructed between a corridor C which has a floor structure F and a hatchway H in which an elevator travels vertically. Formed in the wall W is an entranceway 10; and normally closing the entranceway is a sliding door 11 which is illustrated only diagrammatically in FIGS. 2 and 4. As seen in FIG. 1, the door 11 has a main panel 12 and a base 13. Typically, the door 11 has a core with decorative surfaces 14 and 15 facing the corridor C and the hatchway H, and these decorative surfaces may, for example, be provided by wood grain Formica bonded to the core. The base 13 commonly is a sheet of metal such as stainless steel which is also bonded to the core.

The wall W has ends 16 which form the two sides of the rough entranceway; and the decorative jamb structures of the present invention, indicated generally at 17, conceal the ends 16 of the wall.

The jambs 17 are mirror images of one another, so that only one will be described in detail, and the same reference numerals will be applied to the various parts of both jambs. Each jamb 17 includes a shroud structure, indicated generally at 18; a decorative panel, indicated generally at 19, which is shorter than the shroud 18; and a finishing plate, indicated generally at 20, which in the present instance is a base plate and fills the space between the bottom of the decorative panel 19 and the floor structure F.

Referring now particularly to FIGS. 2 to 5, each of the shrouds 18 has a lower end **18*a* at the floor structure and an upper end 18*b* at a decorative top cross structure 33 of the entranceway, and includes a vertical side element 21 at the corridor side of the wall, a vertical side element 22 at the hatchway side of the wall, and a recessed connecting web 23 between the side elements 21 and 22 and defining with them a central channel 24. The side elements 21 and 22 include, respectively, inner webs 25 and 26 which are perpendicular to the connecting web 23 and form the sides of the channel 24, forward webs 27 and 28 perpendicular to the inner webs 25 and 26, lateral webs 29 and 30 which are parallel to and wider than the webs 25 and 26 so as to overlap the end 16 of the wall W, and return webs 31 and 32** one of which is seen to bear against the corridor side of the wall W.

Figure 2:
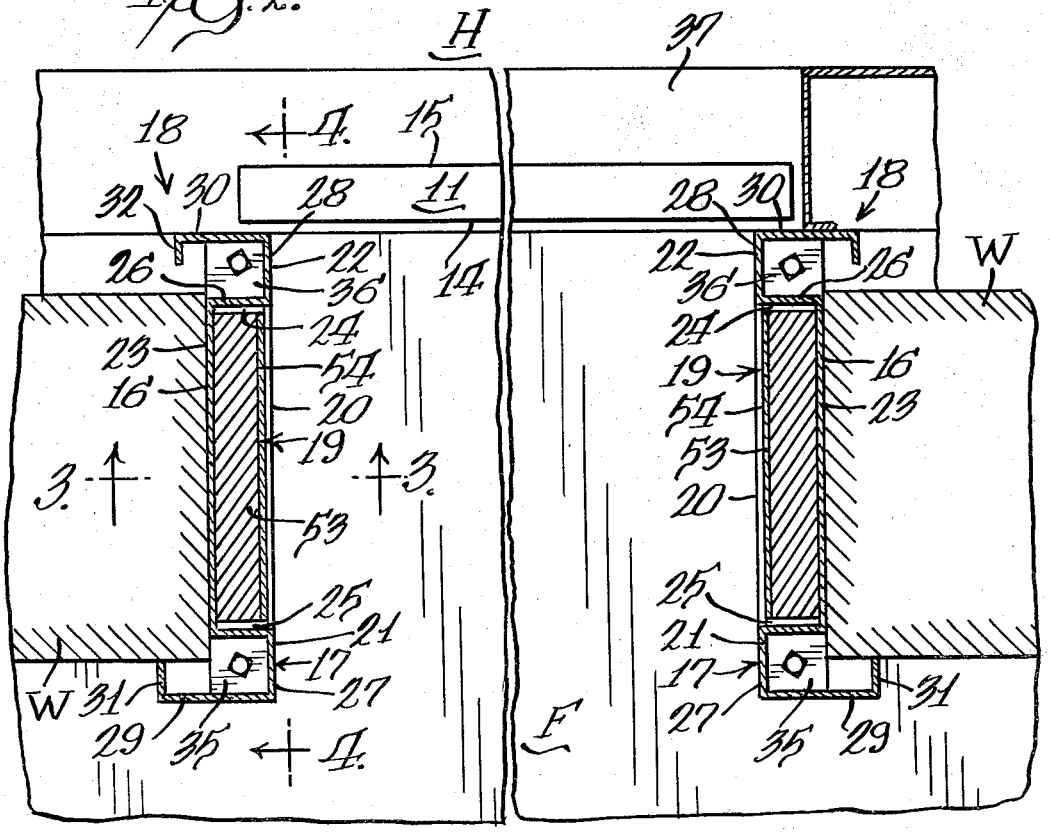
FIG. 2 is a fragmentary sectional view on an enlarged scale taken substantially as indicated along the line 2—2 of FIG. 1.
Figure 4:
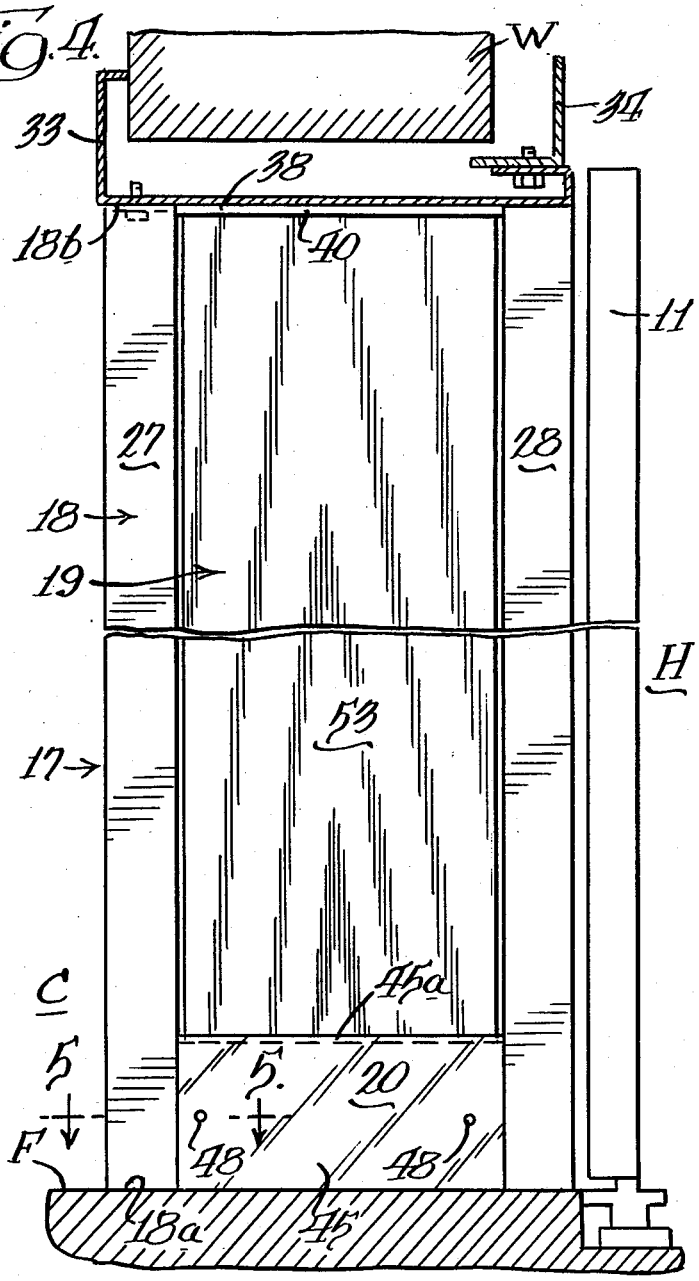
FIG. 4 is a fragmentary vertical sectional view taken substantially as indicated along the line 4—4 of FIG. 2.
Figure 5:
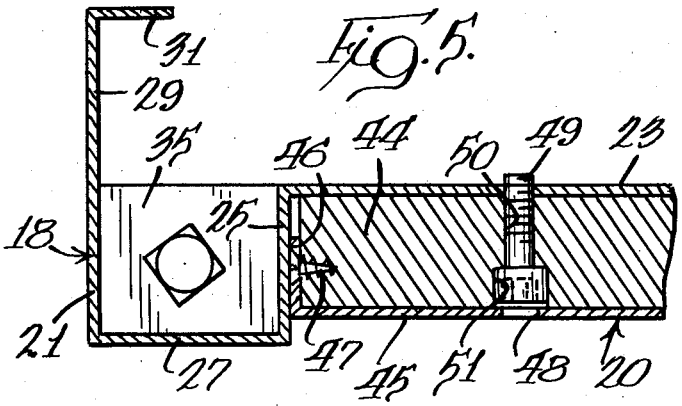
FIG. 5 is a fragmentary horizontal sectional view taken substantially as indicated along the line 5—5 of FIG. 2.

As seen in FIG. 4, the decorative top cross structure 33 for the entranceway provides a support for the corridor side of the shroud 18; and a structural member 34 which provides support for the sliding door 11 affords an upper attachment for the hatchway side of said shroud; and as seen in FIG. 2, transverse plates 35 at the lower ends of the side elements 21 and transverse plates 36 at the lower ends of the side elements 22 receive lag bolts for securing the lower ends of the shroud means 18 to the floor structure F. From the floor structure a sill 37 extends into the hatchway H beneath the sliding door 11.

Figure 3:
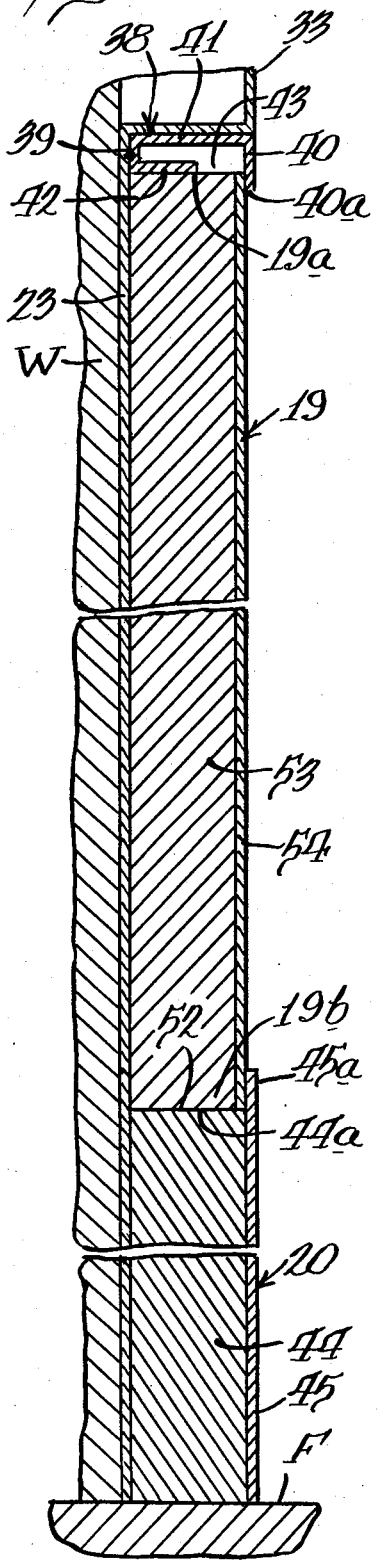
FIG. 3 is a fragmentary vertical sectional view taken substantially as indicated along the line 3—3 of FIG. 2.

Referring now to FIG. 3, the present invention utilizes a retaining flange structure, indicated generally at 38, which includes a mounting web 39 that is secured to the connecting web means 23 of the shroud structure 18 in any desired manner, as by welding, riveting, or fastening screws. A retaining flange 40 is connected to the mounting web 39 by means of a spacer arm 41, and at the lower end of the connecting web 39 is an integral panel abutment plate 42 which extends toward the retaining flange in a plane slightly above the lower end **44*a* of the flange. The retaining flange 40 cooperates with the connecting web 23 of the shroud structure 18 to define a downwardly open pocket 43**.

The finishing plate 20 consists of a wood core 44 and a decorative metal sheath 45 the end portions 46 of which are bent around the ends of the core 44 and receive fastening screws 47 by means of which the sheath 45 is secured to the core, and in addition a bonding material is preferably used between the sheath and the core. The sheath is provided with two holes 48 through which a tool may be inserted to rotate captive Allen screws 49 by means of which the finishing plate is detachably secured to the connecting web 23. In order to accommodate the Allen screws the core 44 is provided with through-bores 50 having counterbores 51 to receive the heads of the Allen screws 49. Although the different scales of FIGS. 1 and 2 do not so indicate, in practice the base plate 13 on the door and the finishing plate 20 of the jamb structure are the same height.

The metal sheath 45 of the finishing plate 20 is seen to have an upper end portion 45*a* which extends above the top 44*a* of the wood core 44 and cooperates with the connecting web 23 to define an upwardly open pocket 52.

Each of the decorative panels 19 includes a wooden core 53 having a decorative outer skin 54 which may, for example, match the wood grain outer surface 14 of the sliding door 11. The decorative panel 19 is detachably mounted in the channel 24 with its upper portion 19*a* and lower end portion 19*b* snugly seated, respectively, in the downwardly open pocket 43 and the upwardly open pocket 52. The depth of the pocket 52 is slightly greater than the distance from the lower end 40*a* of the retaining flange 40 to the plane of the panel abutment 42, so that the panel 19 can be removed only by unfastening the Allen screws 49, removing the finishing plate 20 and sliding the decorative panel 19 downwardly out of the pocket 43.

The retaining flange 40 and the projecting upper end portion 45*a* of the sheath 45 serve to protect the upper end lower margins of the decorative skin 54 of the decorative panel 19 against cracking or chipping which could result from bumping around the upper and lower ends of the panel 19.

The foregoing detailed description has been given for clearness of understanding only and no unnecessary limitations should be understood therefrom as modifications will be obvious to those skilled in the art.

We claim:

1. A decorative jamb for a side of an entranceway that extends through a wall between an elevator hatchway and a building corridor having a floor structure, so that the sides of the entranceway are defined by end surfaces of the wall, there being a decorative top cross structure in the entranceway and a sliding door in the hatchway which normally closes said entranceway, said decorative jamb comprising, in combination:

a decorative shroud structure which has a lower end at the floor structure and an upper end at the top cross structure of the entranceway to conceal the end surface of the wall, said shroud structure having two vertical side elements which are joined by recessed connecting web means to define a vertically extending central channel;

a retaining flange which cooperates with the connecting web means of the shroud structure to define a downwardly open pocket at the upper end of the central channel;

a finishing plate in the lower end portion of said central channel, said finishing plate comprising a core which has an upper end and a decorative sheath which has a top margin above said upper end and cooperates with said connecting web means to define an upwardly open pocket;

fasteners detachably securing said finishing plate to the shroud structure;

and a decorative panel in said channel with its end portions snugly seated in said pockets, the length of said decorative panel being greater than the distance from the top margin of said decorative sheath to the top of the downwardly open pocket, whereby said decorative panel may be removed only by first removing the finishing plate.

2. The combination of claim 1 in which the retaining flange and the decorative sheath are both in a single plane parallel to the connecting web means.

3. The combination of claim 1 in which the top retaining flange is provided with an integral bracket which is fixedly secured to the shroud structure.

4. The combination of claim 3 in which the integral bracket includes a rear mounting web abutting the recessed connecting web means and secured thereto, and a panel abutment extending from said rear mounting web toward the retaining flange above the lower margin of said flange, said panel abutment defining the top of the downwardly open pocket.

5. The combination of claim 1 in which the fasteners are screws which extend through the core and are captive beneath the decorative sheath and in which small holes in said decorative sheath permit insertion of an implement for manually rotating the screws.

* * * * *